US006695218B2

(12) United States Patent
Fleckenstein

(10) Patent No.: US 6,695,218 B2
(45) Date of Patent: Feb. 24, 2004

(54) PREDICTIVE COMFORT CONTROL

(75) Inventor: Joseph Edward Fleckenstein, Reading, PA (US)

(73) Assignee: Joseph E. Fleckenstein, Reading, PA (US)

( * ) Notice: Subject to any disclaimer, the term of this patent is extended or adjusted under 35 U.S.C. 154(b) by 293 days.

(21) Appl. No.: 09/779,574

(22) Filed: Feb. 9, 2001

(65) Prior Publication Data

US 2002/0109011 A1 Aug. 15, 2002

(51) Int. Cl.[7] ..... F24F 7/00; F23N 5/00

(52) U.S. Cl. ..... 236/46 R; 236/49.3; 165/214; 454/229

(58) Field of Search ..... 236/49.3, 46 R; 454/256, 229; 165/214, 267

(56) References Cited

U.S. PATENT DOCUMENTS 4,838,482 A * 6/1989 Vogelzang ..... 236/11
5,020,332 A * 6/1991 Nakatsuno et al. ..... 62/57
5,547,017 A * 8/1996 Rudd ..... 236/49.3

* cited by examiner

*Primary Examiner*—William Wayner

(57) ABSTRACT

A controller that monitors air conditioning operation and performs calculations to determine when operation of the building's circulating fan would improve comfort levels. Based on the results of those calculations, the controller periodically operates the circulating fan throughout a subsequent period of time to moderate temperature and humidity levels. Excessive operation of the circulating fan is avoided. The controller is considered useful for generally improving human comfort levels in sleeping areas and particularly in residential structures consisting of more than a single story.

10 Claims, 6 Drawing Sheets

```
begin:
dirs = %0100000000000000
outs = %0000000000000000
a1    var   byte
a2    var   byte
crun  var   byte
A     var   byte
B     var   byte
C     var   byte
D     var   byte
E     var   byte
F     var   byte
h     var   byte
p     var   byte
perc  var   byte
t1    var   byte
t2    var   byte
t3    var   byte
t4    var   byte
U     var   byte
V     var   byte
W     var   word
X     var   word

init:
debug "init"
crun = 0
A = 0
B = 0
C = 0
D = 0
E = 0
F = 0
h = 0
p = 0
t1 = 0
t2 = 0
t3 = 0
t4 = 0
low 2

excont:
pause 15000
button 1,1,0,0,h,1,timing
goto excont

timing:
if t1 = 60 then case1
pause 60000
t1 = t1 + 1
button 1,1,0,0,h,1,comprun
goto timing

comprun:
crun = crun + 1
goto timing

case1:
perc = (crun*100)/t1
F = E
E = D
D = C
C = B
B = A
A = perc
if perc > 20 then AA
goto LCP

LCP:
if F > 20 then ABC
if E > 20 then ABC
if D > 20 then ABC
if C > 20 then ABC
if B > 20 then ABC
if A > 20 then ABC
goto init
```

Figure 4A

```
ABC:
if A < B then AA
t1 = 0
crun = 0
goto timing

AA:
U = (A + B)/2
V = (C + D)/2
W = (A + B + C)/3
X = (D + E + F)/3
if U < V then AB
t1 = 0
crun = 0
goto timing

AB:
a1 = V - U
if a1 > 16 then WT

AK:
if W < X then AL
t1 = 0
crun = 0
goto timing

AL:
a2 = X - W
if a2 > 12 then WT
t1 = 0
crun = 0
goto timing

WT:
t3 = t3 + 1
if t3 = 100 then WA
goto WT

WA:
B = 0
t3 = 0
h = 0
if X < 50 then XJ
goto YJ

XJ:
pause 60000
t3 = t3 + 1
button 1,1,0,0,h,1,XC

XB:
goto XD

XC:
B = 1

XD:
if t3 = 53 then XE
if t3 = 18 then XL
goto XJ

XL:
B = 0
goto XJ

XE:
t3 = 0
if B = 1 then XM
high 2

XF:
pause 60000
t2 = t2 + 1
if t2 = 7 then XG
goto XF
```

Figure 4B

```
XG:
low 2
t2 = 0
B = 0
p = p + 1
if p > 7 then XH
goto XJ

XM:
B = 0
t3 = 20
p = p + .5
if p > 7 then XH
goto XL

XH:
p = 0
goto S3

YJ:
pause 60000
t3 = t3 + 1
button 1,1,0,0,h,1,YC

YB:
goto YD

YC:
B = 1

YD:
if t3 = 40 then YE
if t3 = 15 then YL
goto YJ

YL:
B = 0
goto YJ

YE:
t3 = 0
if B = 1 then YF
high 2

YF:
pause 60000
t2 = t2 + 1
if t2 = 10 then YG
goto YF

YG:
low 2
t2 = 0
B = 0
p = p + .83
if p > 11 then YH
goto YJ

YM:
t3 = 20
p = p + .5
if p > 7 then YH
goto YL

YH:
p = 0
goto S3

S3:
pause 60000
t4 = t4 + 1
if t4 = 250 then init
goto S3

END
```

Figure 4C

PREDICTIVE COMFORT CONTROL

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO MICROFILCHE APPENDIX

Not Applicable

BACKGROUND OF THE INVENTION

Air-conditioned spaces are typically equipped with a wall mounted thermostat that controls operation of a building's cooling equipment. The wall thermostat is often fitted with a fan switch that allows the occupants to place operation of the air conditioning equipment into 'cool', for automatic control of the cooling equipment, or to switch the equipment to 'off.' Many thermostats also incorporate means for automatically controlling heating equipment. If the thermostat is used for the control of both heating equipment and air conditioning equipment, it may typically be fitted with a switch that permits the occupants to select the 'heat', 'cool' or 'off' modes. Operation of the circulating fan is often controlled by means of a separate switch that allows for 'auto' or 'on' operation of the circulating fan. When the fan switch is in the auto position, the circulating fan is operated whenever the air conditioner is operating. In this manner conditioned air is circulated throughout the inner spaces of the controlled area. If the fan switch is indexed to the 'on' position the circulating fan is operated continually. A large percentage of thermostats are also fitted with a clock that facilitates automatic set-back of the of the thermostat's setpoint.

The function of the thermostat is to maintain the temperature in the controlled space within comfortable temperature limits. Upon a rise in the sensed temperature to the setpoint of the thermostat, the thermostat automatically begins operation of the air conditioning system. In consequence to operation of the cooling equipment, the temperature within the controlled space is maintained within comfortable levels. After the thermostat detects a substantial decrease in temperature, it stops operation of the air conditioning equipment. The cycle is repeated again as the sensed temperature rises and falls. Under average daytime hours, the occupants of the building in which the thermostat is located find little need to intervene with the automatic operation of the air conditioning equipment. However, the described mode of operation fails to provide uniform comfort under a variety of outdoor conditions and at all hours of the day. The deterioration in comfort levels is particularly noticeable to occupants after they retire for the evening. This rise in human discomfort in the occupied spaces is due to a number of causes.

Whenever a building is under a relatively high heat load, the building's air conditioning system is cycled on and off frequently as the wall thermostat responds to detected rises in the air temperature. The resulting frequent operation of the air conditioning system helps to maintain not only the temperatures within the building but the humidity as well. Frequent operation of the building's air conditioning system, together with the attendant operation of the circulating fan, ensures that conditioned air is circulated in a timely manner to all areas of the building. As a result, comfort levels are generally well maintained during the daylight hours of hot days. However, the sensible heat load on a building will generally fall after dusk. Consequently, both the frequency and the duration of operation of the air conditioning system, and the circulating fan, will decrease after dusk. Regardless of the cooling load on the building, the temperature near the thermostat will be adequately maintained. However, the less frequent operation of the air conditioning equipment may cause temperatures in areas remote from the thermostat to rise to uncomfortable levels. These temperature rises occur primarily during the longer 'off' cycles of the cooling equipment. After nightfall, the humidity in occupied bedrooms will also rise due to human respiration. The combination of both a rising temperature and a rising humidity especially contribute to the discomfort of occupants.

The thermostat typically provided with an air conditioning system to detect the controlled temperature is generally located on a wall that is central to the area where the building's occupants spend most of their time during the daylight hours. In a residence, the location chosen for the thermostat is generally not on a bedroom wall. In two-story homes, the wall thermostat would most often be located on the first floor of the residence. Most, if not all, of the bedrooms in a two-story home would generally be on the second floor of the residence. Due to the solar radiation that strikes the building during the daylight hours, the upper and outer portions of the building become heated and rise in temperature. These heated portions of the building act as what may be best described as a 'heat sink.' After the sun sets, these heated portions of the building continue to provide a source of heat that is gradually transferred to the air in the inner spaces of the building. The upper areas of the building continue to receive a disproportionate amount of heat that is transferred from the ceilings, walls and attic areas of the house. As a result of this delayed heat transfer, the air temperatures in the upper spaces of a two-story building may rise considerably above the first floor temperature after dusk.

If the circulating fan is not operated periodically, the humidity in the bedrooms will rise as a result of the respiration of the occupants. The increased humidity will cause a 'stale' effect in a bedroom due to the relatively small volume of air contained within a bedroom. The problem is momentarily remedied if the air conditioning system operates and removes moisture from the air. Alternatively, periodic operation of only the circulating fan can ameliorate the problem. If the fan is operated for an appropriate period of time, the stale air from the bedrooms will be diluted with less humid air from other areas of the building. Periodic operation of the fan will also mix the hotter air from the upper levels of a building with air from the lower story thereby often causing the thermostat to call for operation of the cooling equipment. This operation, in turn, both lowers the temperature throughout the building and simultaneously dehumidifies the circulated air. As a result, the humidity levels are improved along with the improved temperature levels.

Continuous operation of the circulating fan would alleviate the cited problems that are encountered due to long inactivity of the circulating fan. In fact, this practice is often used. However, continuous operation is undesirable for several reasons. First, the sound of the fan continuously operating is considered by many to be disconcerting. Furthermore, continuous operation is wasteful of electrical energy.

Timers have been used in a variety of methods to provide periodic operation of the circulation fan. Some of these methods offer a measure of improved comfort. Nevertheless, all of the known methods contain considerable disadvantages. Some methods provide operation of the circulating fan both at times when that operation would be helpful but also at times when the operation would be bothersome and wasteful of energy. Other arrangements require the frequent, and inconvenient, intervention of the building's occupants to initiate and terminate timer operation.

BRIEF SUMMARY OF THE INVENTION

This invention generally pertains to the field of indoor environmental control and, more specifically, to a means of automatically operating the indoor circulating fan of an air conditioning system. The operation of the circulating fan is under the direction of a controller that records the pattern of usage of the building's air conditioning system, conducts calculations to determine when operation of the circulating fan would improve the comfort of the building's occupants, and, based on those calculations, intermittently operates the circulating fan throughout a period of time.

DETAILED DESCRIPTION OF THE INVENTION

The present invention consists of a control that incorporates a computing device to predict when operation of the building's circulating fan would improve comfort levels within the controlled spaces. The prediction is made in accordance with programmed algorithms that essentially synthesize the pattern of usage of the air conditioning equipment. Based on the results of the calculations, the control, which is herein termed the 'predictive control', then acts to periodically operate the fan throughout a period of time. Operation of the fan is completely automatic, and, since operation is conducted only when required, the control affords an economic means of improving comfort levels within the building. After the initial installation, no human intervention is required to ensure proper operation of the device. The invention provides for improved comfort levels primarily during evening hours and particularly in buildings of two or more stories where people sleep.

In one possible embodiment of the invention, the predictive control would be incorporated into a separate enclosure that is located remote from the thermostat that controls operation of the building's air conditioning system. A configuration of this type may be used, for example, to conveniently and economically retrofit existing installations. On the other hand, the function of the logic device used in the predictive control could be performed by a microprocessor or similar small device. Accordingly, the device could be very small and could readily be incorporated within the enclosure of a wall thermostat. If incorporated into the wall thermostat, the invention could be used in both new installations as well as retrofit installations. It is expected that the most common usage of the invention will be in this later mentioned configuration.

To effectively predict when fan operation would be desirable, the predictive control conducts an analysis of the pattern of air conditioning operation. To perform that function, the predictive control first records air conditioning operation over time. The program then examines the recorded information to determine if fan operation is warranted and, if so, when that operation should be initiated. A number of criteria are applied to make the determination. If fan operation is to be initiated, the frequency of fan operation, the duration of the fan operation and other pertinent parameters are selected to suit the anticipated need. The calculation is conducted only in consequence to detected air conditioning operation. As a result, there will be some days when operation of the fan is frequent and of a relatively long duration. Other days, the fan would be operated less. On many days the fan will not operate whatsoever. If the calculations indicated fan operation is warranted, then fan operation is subsequently initiated. In a simplified version of the invention, the predictive control would merely determine if fan operation is required. If the determination is affirmative, then fan operation would be scheduled to occur over a period of time.

In a preferred embodiment of the invention, the control estimates when the adult occupants will retire to the bedrooms for the evening. That estimation is based on a determination of the significant decrease in operation of the air conditioning equipment that normally occurs at sunset. If fan operation is to be initiated, the beginning of that fan operation is scheduled to correspond to a time when the temperature and humidity in the upper rooms of a two-story building would begin to rise, namely several hours after dusk. More exactly, it is expected that this occurrence would generally coincide with the time when the building's adults retire for the evening.

In an alternate embodiment of the invention, a clock is used to estimate the normal time when the occupants retire. The pattern of usage of the air conditioner is then examined with the programmed criteria to determine if fan operation is warranted. If fan operation is warranted, the fan is subsequently operated by the predictive control for a suitable number of cycles and starting at a selected time.

BRIEF DESCRIPTION OF THE DRAWINGS

FIG. 4 is a copy of a specific computer program that incorporates the general principles of the invention.

DETAILED DESCRIPTION OF A PREFERRED EMBODIMENT

Figure 1:
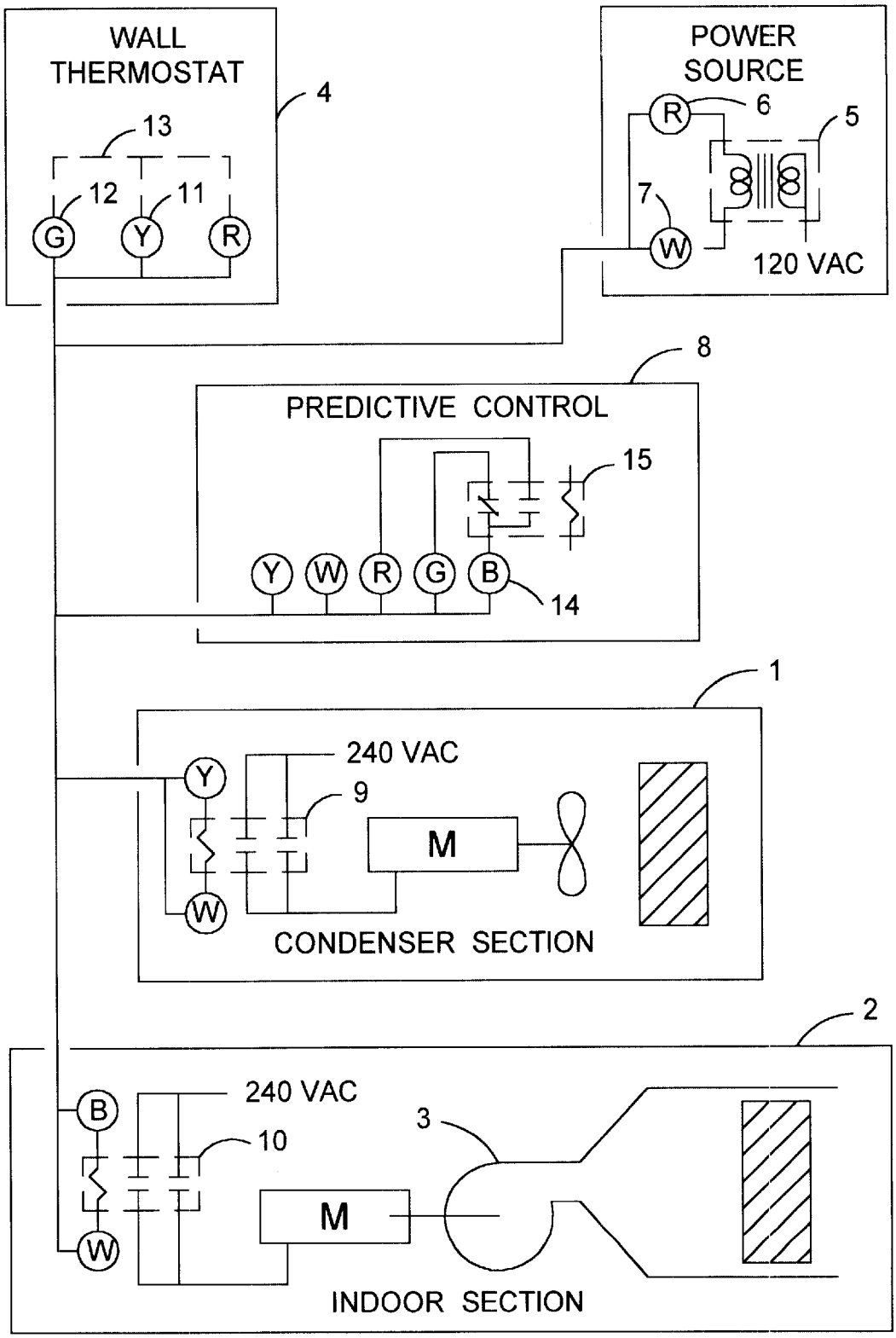
FIG. 1 depicts a typical air conditioning system with the invention installed remotely from the wall thermostat.

A block diagram representation of a typical 'split' system type air conditioning installation that uses the predictive control is represented in FIG. 1. The air conditioning system in the representation is essentially split into two major components that serve to perform the cooling, namely a condenser section 1 and an indoor section 2. The condenser section 1 consists of a refrigerant compressor, a condenser coil, an associated fan, electrical controls and a protective housing. Refrigerant is compressed by the compressor in the condenser section and circulated through the inside of the condenser coil where it rejects heat to the outside air that is circulated on the outside of the condenser coil. The refrigerant is then circulated to the evaporator in the indoor section 2 where the refrigerant is expanded to cool the air that is circulated through the evaporator by the action of the circulating fan 3. A wall thermostat 4 is located in the controlled spaces. Upon a rise in the sensed temperature at the wall thermostat 4, the wall thermostat 4 calls for simultaneous operation of the refrigerant compressor, the associated condenser fan and the indoor circulating fan 3.

Electrical power used to operate the controls of an air conditioning system is often at a voltage other than that used to power the motors of the system and may be, typically, 24 volts alternating current. A transformer 5 derives the lower voltage from a power source that is at a higher voltage. For the purposes of illustration, the voltage supplied to the control system illustrated in FIG. 1 is shown as supplied to the 'R' (red) circuit 6 and the 'W' (white) circuit 7. Voltage of the R circuit 6 is distributed to wall thermostat 4 and to the predictive control 8. The W circuit 7 is wired to the circulating fan relay 10, the condenser section contactor 9 and the predictive control 8. Whenever the wall thermostat 4 acts to energize the air conditioning system, it completes a circuit from the R circuit 6 to the Y (yellow) circuit 11 thereby energizing contactor 9 of the outdoor section. The R circuit 6 is likewise connected to the G (green) circuit 12 to call for fan operation. The G circuit 12 at the wall thermostat is activated every time the Y circuit 11 is activated, but it may also be activated independently, by means of a 'fan-on-auto' switch. The circuit that connects the Y circuit 11 and the G circuit 12 is illustrated as circuit 13 in FIG. 1.

All of the electrical circuits of the air conditioning control system are connected to the predictive control 8 for use by the predictive control 8. The circuits of the air conditioning control system include all of the aforementioned circuits, namely the R circuit 6, the W circuit 7, the Y circuit 11 and the G circuit 12 as well as the B circuit 14 that originates at the predictive control. The predictive control 8 requires the voltage of R circuit 6 and W circuit 7 for operation of the microprocessor. The Y circuit 11 is connected to the predictive control 8 so as to provide a signal indicative of air conditioning operation. The B circuit 14 originates at the predictive control so that fan operation is either allowed in accordance with the demands of wall thermostat 4 or in accordance with the requirements of the predictive control 8. If circulating fan 3 operation is not demanded by the predictive control 8, fan relay 10 is in the normal position allowing operation of the fan relay 10 to be in accordance with the demands of the wall thermostat 4. Whenever fan relay 15 is energized, the voltage of R circuit 6 is impressed upon the connection to the circulating fan relay 10 thereby demanding operation of the circulating fan 3.

The wall thermostat 4 normally energizes the circulating fan 3 at the same time the condenser section 1 is energized. Use of the predictive control 8 would in no manner alter the manner in which the wall thermostat 4 controls the condenser section 1 and the circulating fan 3. Likewise, the predictive control 8 would not alter the occupants' capability to independently operate the circulating fan 3 by means of, say, a fan 'auto-on' selector switch located on the wall thermostat.

Figure 2:
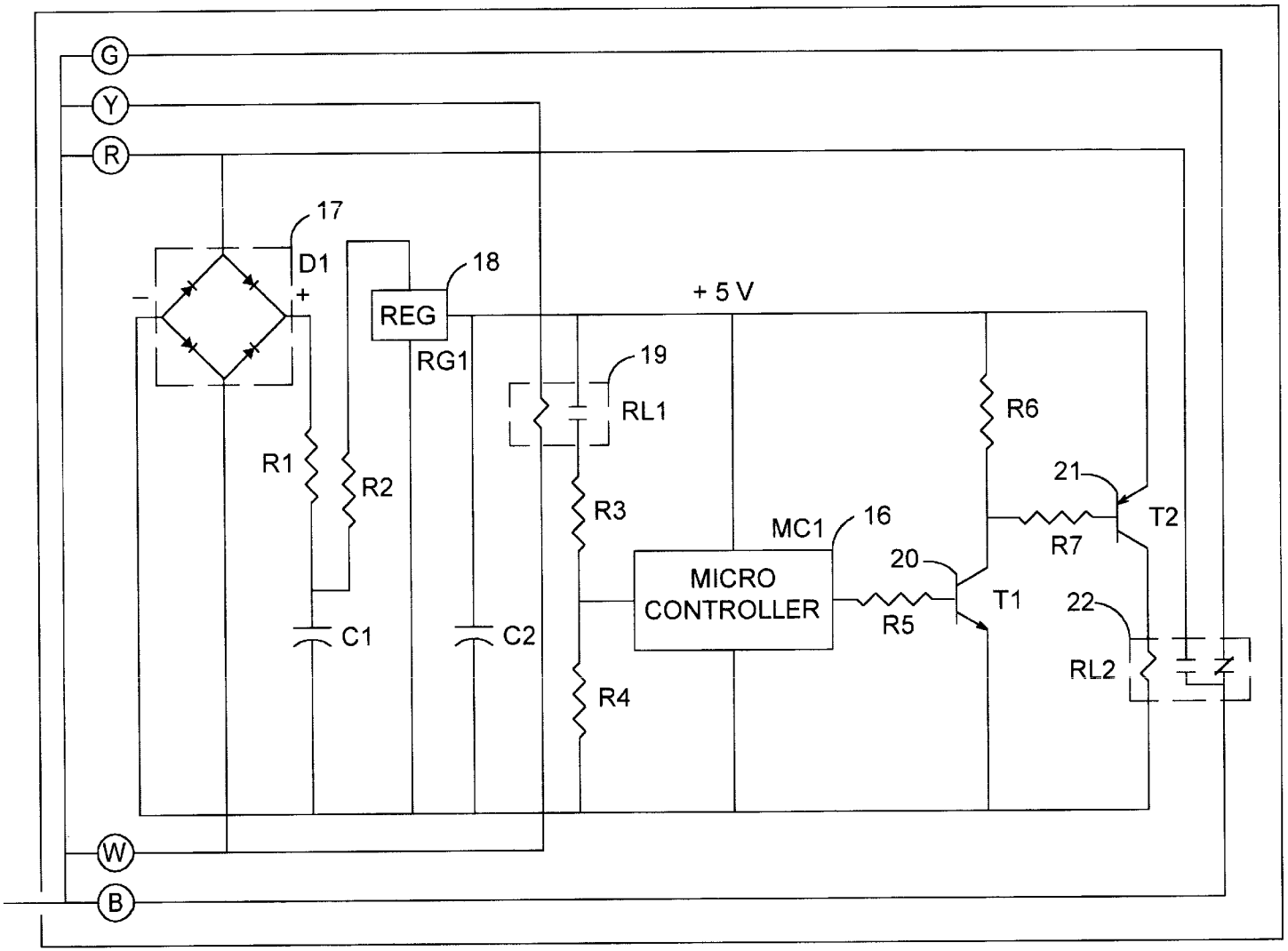
FIG. 2 illustrates the typical details of construction of a specific logic device that performs the logic functions of the predictive control.

The construction of a typical embodiment of the predictive control is represented in FIG. 2. The predictive control shown in the representation includes a microcontroller that executes the calculations according to a developed algorithm. The computing device is described here as a microcontroller but the function of the device could be performed by a number of other, known computing devices as a programmable logic controller or a computer. In most expected applications of the invention, space would be limited. For this reason, it is expected the chosen computing device for any specific application would be relatively small in size. Typically, the computing device would be similar to the 'BASIC Stamp 2' microcontroller that is manufactured by Parallax, Inc. The operation and programming of the mentioned microcomputer are explained in detail in the trademarked publication 'BASIC Stamp Manual.' Parallax, Inc describe the 'BASIC Stamp2 as a computer that fits into a small space. The mentioned computer consists of several integrated circuits but the primary devices are identified as a PIC16C57 microcontroller and a 24LC16B EEPROM. Microcontroller 16 requires direct current voltage for normal operation. In the representation of FIG. 2 this direct current electrical power is derived from the 24 volts alternating current of the air conditioning control system. The alternating current is converted to direct current voltage through the action of bridge rectifier 17, low voltage regulator 18 and a number of associated passive electrical components arranged typically as represented in FIG. 2. Operation of the air conditioning system is denoted by activation of the Y circuit 11. When the Y circuit 11 is activated, relay 19 is energized and this action is converted to a logic "1" input to the microcomputer. A logic "1" output of the computer drives a NPN transistor 20. Transistor 20, in turn, drives a PNP power transistor 21 that energizes relay 22. Whenever relay 22 is energized, the B circuit is activated thereby demanding operation of the circulating fan. When relay 22 is de-energized, operation of the circulating fan is under the control of the wall thermostat 4.

Figure 3:
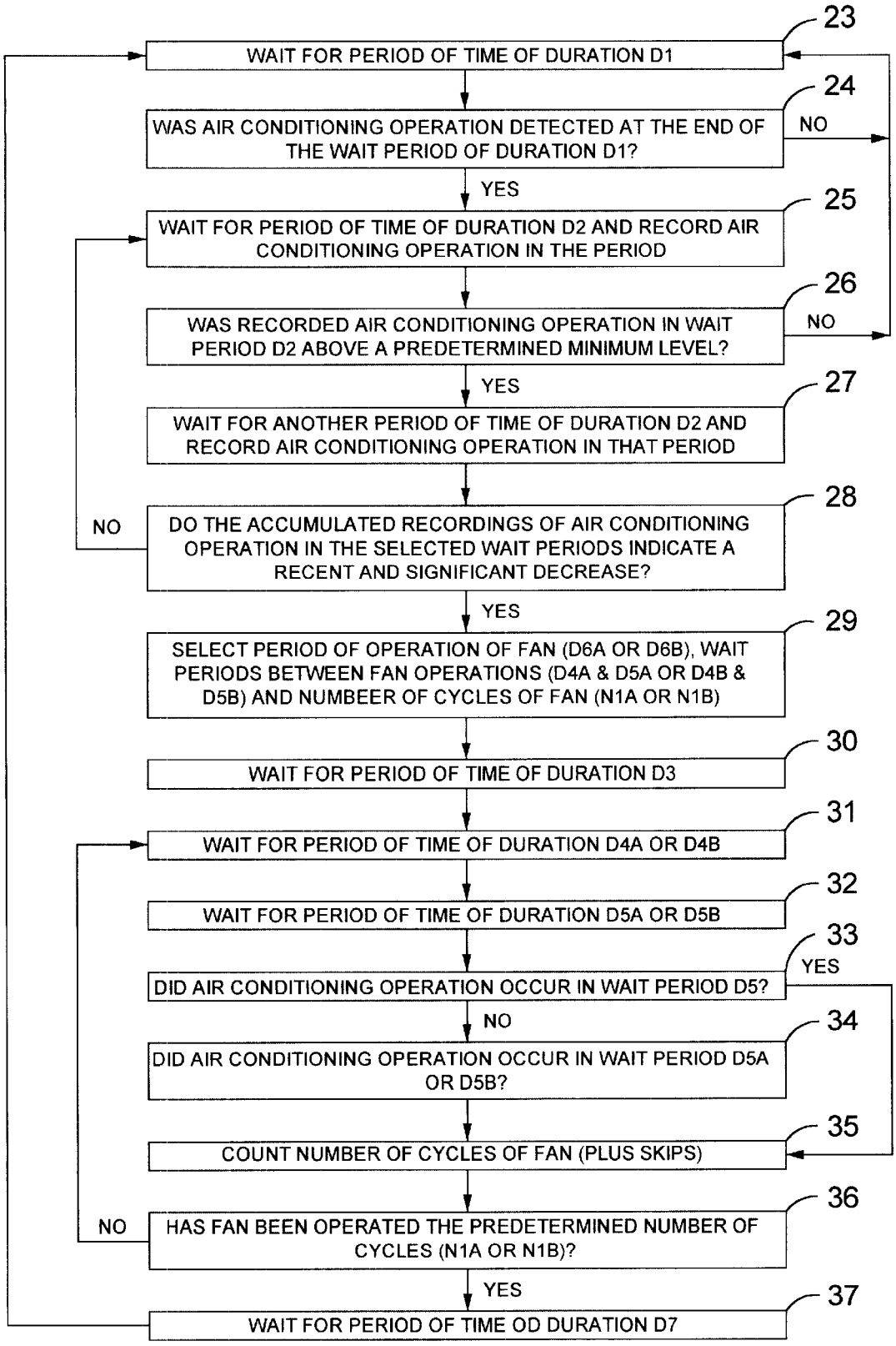
FIG. 3 represents the typical logic steps used to perform the function of the invention.

Whatever computing device is used, it must be programmed to perform computations in accordance with selected algorithms. The flow diagram of FIG. 3 represents the typical logic that would be employed to perform the functions of the invention. At block 23 the program waits for a predetermined period of time D1 and then moves to block 24 to examine the input to determine if there is air conditioning system operation at the end of period D1. If no air conditioning system operation is detected at that time, the program returns to block 23 and waits for another period of time of duration D1. If operation is detected, the program moves to block 25 where the predictive control begins an evaluation k throughout the period of time of duration D2. During the period D2, the net time of air conditioning system operation throughout the period D2 is recorded. At the end of a period of evaluation the program moves to block 26 where the program analyzes the recorded levels of air conditioning operation in the period of duration D2. The program performs a computation to quantify the level of air conditioning operation in the period by dividing the net time of air conditioning operation in the period by the duration of the period D2. The level of air conditioning activity is then compared to an arbitrary value to determine if the air conditioning operation for the period is to be classified as 'significant' or 'insignificant.' If the level of air conditioning activity is classified as insignificant, the program returns to block 23, resumes a watch for subsequent air conditioning operation and forgoes a call for subsequent cycling of the circulating fan. If the operation is determined to be significant, then additional steps of evaluation are to be conducted and the program moves to block 27 where the program continues to evaluate subsequent air conditioning activity. The predictive control begins this function by waiting for another period of duration D2 and recording the net air conditioning system operation in that period.

The program periodically completes the cycle from block 25 to block 28 to determine if there was a significant decrease in air conditioning operation. If a significant decrease in air conditioning operation is detected at block 28 the program essentially concludes that subsequent cycling of the fan would enhance the comfort level of the building's occupants. Accordingly, the program moves to block 29 and schedules subsequent fan operation. The scheduling of fan operation is based on the level of air conditioning operation that was recorded earlier. At block 29 the program selects the length of the period of fan operation, the duration between fan operations and the length of the period throughout which the fan is to be cycled. Had the recordings of the air conditioning operation indicated a relatively low level of air conditioning activity, the program schedules a less intense level of fan operation. Shorter periods of fan operation, longer durations between fan operations and a smaller number of fan cycles will characterize the less intense level of fan activity. In FIG. 3, the shorter duration of fan operation is designated by duration D6A. The corresponding longer durations between fan cycles are represented by durations D4A and D5A. The smaller number of fan operations by the count N1A. A higher level of air conditioning operation will result in longer periods of fan operation, shorter delays between cycles of the fan and a larger number of fan cycles. The more intense air conditioning operation would result in durations D6B, D4B and D5B and fan operations Ni B.

If the program is used without a provision of a clock, then the program concludes that a significant decrease in air conditioning operation may coincide with nightfall. It then schedules fan cycling to commence at a time that would roughly coincide with that time when the building's occupants would retire for the night. Typically, the beginning of the fan operation would be scheduled to coincide with a time that would be approximately three to five hours after a significant decrease in air conditioning operation had been noted, or, roughly, 9 PM to 12 PM. If the predictive control detects a decrease in air conditioning activity at a time other than at dusk, there is no resulting problem. Cycling of the fan at times following a decrease in air conditioning activity will generally enhance the comfort levels of the building's occupants regardless of the time of day.

After block 29 the program advances to block 30 and waits for a period of time of duration D3. Duration D3 would approximate the delay from the detected significant decrease in air conditioning operation until the building's occupants retire for the evening. As the scheduled time for fan operation approaches, the program moves to block 31 where it waits for another period of time of duration D4A or D4B. Upon completion of timing period D4A or D4B, the timing of period D5A or D5B commences as indicated by block 32. If air conditioning operation is detected in period D5A or D5B, then the program essentially decides that immediate cycling of the fan would be unnecessary. Accordingly, cycling of the fan is momentarily deferred. It is noted that air conditioning operation in period D4A or D4B has no influence on the pending determination to cycle the fan. If air conditioning operation is not noted in period D5A or D5B, then the program moves to operate the fan for a period of time D6A or D6B as indicated by block 34.

Had fan operation been detected during wait period D4A or D4B, fan operation is skipped in the immediate cycle and the program moves to block 35 where the skip is counted along with the number of cycles of the circulating fan. At block 36 the count of the number of cycles of the fan plus the skips are compared to the predetermined number of cycles and skips. If the net number of cycles and skips is less than the predetermined number, then the program returns to block 31 and begins another wait of duration D4A or D4B. The described cycle of the program from block 31 to block 36 is again repeated. If the count of cycles and skips matches the predetermined number, then the program moves to block 38 and waits for a period of duration D8 before returning to block 23 to repeat the described logic process. The count of fan cycles plus skips is used as an approximation of the predetermined period of time throughout which fan operation is to be conducted.

The optimum values of the lengths of the wait periods D1 through D7 may vary from one installation to another. The selection of these values will depend on a number of factors including site latitude, building size, owner preferences and a variety of other conditions. It is expected that one skilled in the art may readily perform the selections of these values for specific sites or specific geographical areas. The following list of parameters are considered typical values that would be expected to be satisfactory for a large number of installations:

D1: 15 seconds

D2: 60 minutes

D3: 100 minutes

D4A: 18 minutes

D4B: 15 minutes

D5A: 35 minutes

D5B: 25 minutes

D6A: 7 minutes

D6B: 10 minutes

D7: 250 minutes

N1A: count equivalent to a period of 7 hours

N1B: count equivalent to a period of 11 hours

A program of some sort is required to direct the computing operations of the device used to control operation of the predictive control. A typical program for the type of logic cited above is represented in FIG. 4. The program shown in FIG. 4 is an actual program that was developed for the BASIC Stamp2 computer mentioned above. The described program essentially mimics the logic presented in FIG. 3. The program language of FIG. 4 is termed 'PBASIC' by the manufacturer and it resembles in most regards the commonly used 'BASIC' programming language. The terms of the programming language are explained in the trademarked text mentioned above. It is to be recognized that there are numerous programming languages besides the BASIC and PBASIC programs mentioned here. Many of these would be capable of performing the logic steps essential to the principal of this invention. The functions of the subroutines of the program presented in FIG. 4 are explained in the following text.

The assignments of inputs are made in the 'begin' subroutine. Specifically, Pin #1 is designated as an input pin. Also in the 'begin' subroutine, the sizes of the variable word sizes are described. The program enters the 'init' subroutine whenever the control is initialized, i.e. whenever there is no previous record of air conditioning operation that is to be retained for analysis. The program enters the 'excont' subroutine to begin a watch for operation of the air conditioning system. In the subroutine of FIG. 4, the input contact is examined every 15 seconds for air conditioning operation. If the predictive control finds the contact is closed, indicating operation of the air conditioning system, the subroutine moves to the 'timing' subroutine to clock a period of 60 minutes. If operation of the compressor of the air conditioning system is detected during the 60 minute period, the minutes of operation are recorded in the 'comprun' subroutine. At the end of the 60-minute period of evaluation, the program moves to the 'case1' subroutine where the percentage of net air conditioning operation in the recent 60-minute period is calculated and recorded.

In the 'case1' subroutine the program makes a calculation to decide if the percentage of operation is above a predetermined minimum value which, in this instance, is set at 20%. If it is determined that the amount of air conditioning operation was above 20% then the program decides that the program may proceed with further consideration of cycling of the circulating fan and goes to the 'AA' subroutine. If the operation is found to be below the predetermined minimum of 20%, then the program proceeds to subroutine LCP where it examines the past six periods to determine if there had been the predetermined minimal operation in any of those periods. If none of the periods had minimal operation, then the program returns to the 'init' subroutine where it will initialize all variables and then move to the 'excont' subroutine to resume a watch for air conditioning operation. If there had been air conditioning operation above a minimal amount in at least one of the last six periods of evaluation, the subroutine moves to the 'ABC' subroutine where the subroutine compares the operation in the most recent period to the preceding period. If there was a detected decrease, then the program advances to the 'AA' subroutine. Otherwise, the program returns to the 'timing' routine. The program continues to record the percentage of air conditioning operation and retains the recordings of those operations for the last six periods. Recordings beyond the last six periods are discarded. At every period the program watches for operation that would qualify as a significant decrease. The program continues this watch until a significant decrease is found or until the level of air conditioning operation is found to be below a minimum level.

In the 'AA' subroutine, the program makes several calculations in an effort to determine if there has been a significant decrease in air conditioning operation. The program requires that in order to advance to the 'AB' subroutine, the program must find that the average operation in the last two periods of operation was less than the operation in the preceding two periods of operation. Otherwise the program returns to the 'timing' subroutine for additional evaluations.

In the 'AB' subroutine, the program determines if the duration of air conditioning operation in the last two periods of operation were less than the preceding two periods by an average of 16%. If the determination is affirmative, then this condition is considered a significant decrease and the program advances to the 'WT' subroutine. If the percentage of operation in the 'AB' subroutine is found to be below the predetermined minimum, then the program goes to the 'AK' subroutine. In the AK subroutine the program compares the average of the operation in the past three periods of operation to the operation in the preceding three periods of operation. If the average in the past three periods is not less than the average in the preceding three periods, then the program returns to the 'timing' subroutine. Otherwise the program moves to the 'AL' subroutine. In the 'AL' subroutine, the program requires that, for further consideration of cycling of the circulating fan, the average in the past three periods must be less than the average in the preceding three periods by 12%. Otherwise, the program returns to the 'timing' subroutine to resume the evaluation of subsequent periods of time. If the computed average in the Al subroutine is above 12% then the program advances to the 'WT' subroutine.

When the program moves to the 'WT' subroutine, it has been decided that there has been a significant decrease in air conditioning operation and that human comfort levels can be enhanced by subsequent operation of the circulating fan. However, there is to be a waiting period of 100 minutes before cycling of the circulating fan is to be considered further. After 100 minutes, the program moves to the 'WA' subroutine. In the 'WA' subroutine the program classifies the nature of the air conditioning operation that was recorded earlier and was the criteria for the determination to cycle the circulating fan. If the day was a relatively mild day, then the sum of the averages of the last three periods of observation will be under 50 and the program is to then proceed to the 'XJ' subroutine. If the program finds the air conditioning load to be more severe, the program is to proceed to the 'YJ' subroutine.

In the 'XJ' subroutine, the program begins counting for a period of time before considering operation of the circulating fan, and it also watches for air conditioning operation. If air conditioning operation is detected, then it advances to the 'XC' subroutine where the variable 'B' is changed to '1.' After the 'XC' subroutine, or if there is no detection of air conditioning operation, then the program proceeds to the 'XD' subroutine. In the 'XD' subroutine the program watches the count established in the 'XJ' subroutine. When that count rises to 18 minutes, the program resets the value of 'B' to 0 by transferring the program to the 'XL' subroutine. When the count rises to 53 minutes, the program moves to the 'XE' subroutine.

In the 'XE' subroutine the program may call for operation of the circulating fan. However, the program first examines the value of 'B.' If the value of B equals '1' there had been operation of the air conditioning system within the last 35 minutes and operation of the circulating fan is considered unnecessary. If operation of the fan is forgone, then the program moves to subroutine 'XM.' If it is determined in the XE subroutine that there had been no operation of the air conditioning unit within the past 35 minutes, then the circulating fan is operated and the program moves to subroutine 'XF' where the time of operation is clocked. After seven minutes, operation of the circulating fan is stopped. The program then moves to subroutine 'XG' where the program clocks that period throughout which cycling of the fan is to be allowed. When that tabulation rises to the equivalent of seven hours, cycling of the fan is halted and the program moves to subroutine 'S.' The seven-hour period corresponds roughly to the first seven hours of time when the adults in a building are sleeping. The end of the seven hour period would correspond roughly to the time of the morning when the heating load on the building is reduced. Also, the heat transfer from heated exterior members of the building would have been completed. Accordingly, the need for fan cycling would be decreased. In the S subroutine there is a mandatory wait of 250 minutes before the program will consider further evaluations.

The program would also advance to the 'XM' subroutine if air conditioning operation had been detected in the 33 minutes prior to the scheduled fan operation. In the 'XM' subroutine the parameter 'B' is reset to a value of 0 and the time is set to 20 minutes. By this procedure the program calls for operation of the circulating fan in another 33 minutes unless there is again operation of the air conditioning unit within that period of time.

The subroutines that begin with a 'Y' have the equivalent function of those subroutines with an 'X' prefix but are used only when it has been determined that the air conditioning unit operation was at a higher intensity as would develop on a warmer day. Essentially, the subroutines with the 'Y' prefix call for more frequent fan operation, longer periods of fan operation and fan cycling that extends over a longer period of time.

The program described above is intended primarily for use in combination with a wall thermostat that lacks a clock or timing device. The program essentially watches for the normal decrease that follows sundown and the associated decrease in the intensity of air conditioning operation. If circulating fan operation is to be initiated, the program seeks to begin that fan operation at a time that coincides with the time that the adult occupants of the building would retire for the evening. If the predictive control is to be used in conjunction with a wall thermostat that is fitted with a clock or similar timing device, then a somewhat different program would be employed.

If the predictive control is used with a wall thermostat that has a clock, there would be no need to establish if there had been a significant decrease in air conditioning operation. Rather, there would be need to merely establish that there had been significant air conditioning operation during the daylight hours. If the predictive control establishes that there had been significant air conditioning operation, then the predictive control considers initiating circulating fan operation at the time corresponding to the time when the adult occupants would normally retire for the evening. The mentioned clock, or a like timing device, would provide an accurate and consistent determination of that activity. Since many wall thermostats are fitted with clocks for temperature set-back, it is expected that the invention will be used extensively in these types of applications.

The specific embodiments presented herein are presented primarily for the purpose of demonstrating some of the methods in which the invention may be constructed and implemented. Nevertheless, it will be apparent to those skilled in the art that there are numerous, possible embodiments to the invention that is disclosed herein. It will likewise be apparent that the specific values of parameters used in the descriptions of embodiments were cited merely for the purposes of illustration and that these values may be varied to fit specific uses of the invention.

I claim:

1. A computing device for use in combination with the controls of a building's air conditioning system and a clock or timing device, said device having the capability to determine those occasions when air conditioning operation is significant and which device, based on a set of programmed calculations, periodically operates the building's circulating fan throughout a period of time that would be during the normal sleeping hours of the building's adult occupants.

2. A computing device of the type described in claim 1 for use in combination with the controls of a building's air conditioning system and a clock or timing device, said device having the capability to determine those occasions when significant air conditioning operation is followed by periods of decreased air conditioning operation and which device, based on a set of programmed calculations, periodically operates the building's circulating fan throughout a period of time that would be during the normal sleeping hours of the building's adult occupants.

3. A computing device of the type described in claim 1 for use in combination with the controls of a building's air conditioning system and a clock or timing device, said device having the capability to determine those occasions when significant air conditioning operation is followed by periods of decreased air conditioning operation and which device, based on a set of programmed calculations, periodically operates the building's circulating fan throughout a period of time that would be during the normal sleeping hours of the building's adult occupants.

4. A computing device of the type described in claim 1 for use in combination with the controls of a building's air conditioning system and a clock, said device having the capability to monitor, record and analyze air conditioning operation during the normal daylight hours and to determine, based on programmed algorithms, if operation of the building's circulating fan would be beneficial to human comfort levels during the normal sleeping hours, and, if so, periodically operate the circulating fan throughout the normal sleeping hours.

5. A computing device of the type described in claim 1 for use in combination with the controls of a building's air conditioning system and a clock or timing device that performs all or some of the following functions:

a. monitors operation of the building's air conditioning system during normal daylight hours b. when air conditioning operation is detected initiates a period of evaluation, c. records air conditioning operation in selected periods of time by either recording the total running time of the air conditioning system within a period of time or by recording the net number of operations of the air conditioning system, d. retains in memory the records of air conditioning operation for a predetermined number of periods, e. during the normal sleeping hours of the building's occupants, as determined by a clock, decides if, based on the accumulated data, operation of the circulating fan is warranted, f. if operation of the building's circulating fan is determined to be warranted, schedules cycling of the building's circulating fan, g. ahead of the scheduled operation of the circulating fan continues to monitor the air conditioning operation and in the event of recent air conditioning operation foregoes the scheduled fan operation, h. in the absence of operation of the air conditioning system prior to the scheduled circulating fan operation, begins operation of the circulating fan, i. ceases operation of the circulating fan after a period of time considered adequate to improve human comfort in the occupied spaces, j. delays operation of the circulating fan before resuming the cycle of circulating fan operation and delays, k. after the circulating fan has been operated throughout a period of time or for a predetermined number of cycles, ceases cycling of the circulating fan, l. delays resumption of additional evaluations of operation of the air conditioning system, m. resumes monitoring of the operation of the air conditioning system, n. automatically repeats the described cycle of operation as required in order to maintain comfort levels over an extended period of time.

6. A computing device for use in combination with the controls of a building's air conditioning system, said device having the capability to determine those occasions when significant air conditioning operation is followed by periods of decreased air conditioning operation and which device, based on a set of programmed calculations, periodically operates the building's circulating fan throughout a subsequent period of time.

7. A computing device of the type described in claim 6 for use in combination with the controls of a building's air conditioning system, said device having the capability to determine those occasions when significant air conditioning operation is followed by periods of decreased air conditioning operation and which device, based on a set of programmed calculations, periodically operates the building's circulating fan throughout a subsequent period of time while avoiding unnecessary operation of the circulating fan.

8. A computing device of the type described in claim 6 for use in combination with the controls of a building's air conditioning system which computing device is used to determine when air conditioning use has significantly decreased and which device, based on programmed algorithms, acts to operate the building's circulating fan whenever computations performed by the computing device indicate that operation of the building's circulating fan would improve human comfort levels within the building.

9. A computing device for use in combination with the controls of a building's air conditioning system, said device having the capability to monitor, record and analyze air conditioning operation during the normal daylight hours and to determine, based on programmed algorithms, if operation of the building's circulating fan would be beneficial to human comfort levels during the normal sleeping hours, and, if so, periodically operate the circulating fan throughout the normal sleeping hours.

10. A computing device for use in combination with the controls of a building's air conditioning system that performs all or some of the following functions:

a. monitors operation of the building's air conditioning system, b. when air conditioning operation is detected initiates a period of evaluation, c. records air conditioning operation in selected periods of time by either recording the net air conditioning running time or the total number of operations of the air conditioning system, d. retains the records of air conditioning operation for a predetermined number of periods and then discards the oldest records, e. based on programmed algorithms, periodically reviews the retained records of air conditioning operation to determine the level of the intensity of air conditioning operation, f. periodically reviews the retained records of air conditioning operation to determine when the pattern of usage indicates there is a significant decrease in air conditioning operation, g. when the computing device calculates that, based on the programmed algorithms, there has been a significant decrease in air conditioning operation, schedules periodic operation of the building's circulating fan, h. determines the intensity of circulating fan operation that is to be used as a function of the level of air conditioning usage that has been recorded, i. ahead of the scheduled operation of the circulating fan, continues to monitor the air conditioning operation, j. in the absence of operation of the air conditioning system prior to the scheduled circulating fan operation, begins operation of the circulating fan, k. ceases operation of the circulating fan after a short period of time, l. delays operation of the circulating fan before resuming the cycle of circulating fan operation and delays, m. after the circulating fan has been operated throughout a period of time, ceases cycling of the circulating fan, n. delays resumption of additional evaluations of operation of the air conditioning system, o. resumes monitoring of the operation of the air conditioning system, p. automatically repeats the described cycle of operation as required in order to improve comfort levels over an extended period of time.

* * * * *